US009777716B2

(12) United States Patent
Nelson et al.

(10) Patent No.: US 9,777,716 B2
(45) Date of Patent: Oct. 3, 2017

(54) DUAL DISPLACEMENT FLUID LEVEL CONTROL PUMP

(71) Applicants: Richard Nelson, Rosamond, CA (US); Robert M Nelson, Rosamond, CA (US); Robert K Dyas, Rosamond, CA (US)

(72) Inventors: Richard Nelson, Rosamond, CA (US); Robert M Nelson, Rosamond, CA (US); Robert K Dyas, Rosamond, CA (US)

( * ) Notice: Subject to any disclaimer, the term of this patent is extended or adjusted under 35 U.S.C. 154(b) by 766 days.

(21) Appl. No.: 13/986,886

(22) Filed: Jun. 14, 2013

(65) Prior Publication Data

US 2014/0369855 A1 Dec. 18, 2014

(51) Int. Cl.
*F04B 23/02* (2006.01)
*F04B 17/04* (2006.01)

(52) U.S. Cl.
CPC ..... *F04B 23/025* (2013.01); *F04B 17/044* (2013.01); *F04B 23/02* (2013.01); *Y10T 29/49117* (2015.01)

(58) Field of Classification Search
CPC ..... F04B 23/025; F04B 17/044; F04B 23/02; F04B 17/046; F04B 7/0076; F04B 2205/063; F04B 35/045; F04B 17/04; F04B 23/026; F04B 49/06; F04B 49/08; F04B 49/22; F04B 2205/06; F04B 23/04; F04B 23/06; F04B 53/1075; F04B 53/12; F04B 53/121; F04B 17/048; F04B 19/22; F04B 23/028; F04B 41/02; Y10T 29/49117
USPC ..... 417/417, 44.1, 410.1, 138, 258, 262, 53, 417/38, 259, 260, 307, 523, 534, 545, 417/546, 547, 550, 552, 553
See application file for complete search history.

(56) References Cited

U.S. PATENT DOCUMENTS 2,280,030 A * 4/1942 Ragatz ..... C10G 21/10 116/109
3,402,734 A * 9/1968 Robbins, Jr. ..... F16K 17/0433 137/491

(Continued)

OTHER PUBLICATIONS

U.S. Appl. No. 13/986,886—Vickers—500700EN1099M.*

(Continued)

*Primary Examiner* — Theodore Stigell
*Assistant Examiner* — Jon Hoffmann
(74) *Attorney, Agent, or Firm* — Matthew C. McCartney, Esq.; Eastman & McCartney LLP

(57) ABSTRACT

A pump for exchange of fluid between an apparatus reservoir and a reserve reservoir. The pump may have an elongated tubular body with a central bore with a reservoir end portion, an inlet end portion and an intermediate barrel portion. A piston assembly with a driving piston with a stem member with nonmagnetic properties attached and the stem member has a tubular extension member attached with all in longitudinal axis alignment slidably positioned in the central bore to position the driving piston adjacent to an electromagnetic coil assembly that is positioned around the intermediate barrel portion and to position the tubular extension member for a reservoir end to extend outwardly at the reservoir end portion opening. An output tubular member with a pressure relief valve is attached to an output port in a side wall of the reservoir end portion positioned for release of fluid through an output port.

11 Claims, 3 Drawing Sheets

(56) References Cited

U.S. PATENT DOCUMENTS 3,556,684 A * 1/1971 Rouquette ..... F02B 1/00 417/307
3,844,528 A * 10/1974 Massie ..... F01L 9/02 251/30.04
4,099,450 A * 7/1978 Mase ..... B23Q 5/26 83/617
4,278,406 A * 7/1981 Cooperrider ..... F04B 17/046 417/199.2
4,312,182 A * 1/1982 Filderman ..... B60T 11/24 60/554
4,376,449 A 3/1983 Nelson
4,496,287 A 1/1985 Nelson
4,747,300 A 5/1988 Nelson
4,989,560 A * 2/1991 Rasdal ..... F01M 11/04 123/196 S
5,806,472 A * 9/1998 Nelson ..... F01M 11/0458 123/196 S
6,607,361 B1 * 8/2003 Kotter ..... B05B 9/0409 417/383
6,942,470 B1 * 9/2005 Versini ..... A47J 31/4403 417/307
8,251,194 B2 * 8/2012 Fujii ..... F16H 61/0021 192/3.58
2003/0066638 A1 * 4/2003 Qu ..... C09K 5/14 165/186
2010/0266421 A1 * 10/2010 O'Connor ..... F04B 15/02 417/6
2011/0263381 A1 * 10/2011 Katou ..... F16H 61/0021 477/115
2012/0251359 A1 * 10/2012 Neelakantan ..... F04B 17/046 417/416
2015/0174708 A1 * 6/2015 Maksimov ..... B23P 9/025 72/393

OTHER PUBLICATIONS

U.S. Appl. No. 13/986,886—Reserve Systems—Product Support—Jan. 2011.*
U.S. Appl. No. 13/986,886—Reserve Systems—CLCSystems—Jan. 2011.*
U.S. Appl. No. 13/986,886—Reserve Systems—AutoOil-LevelSystms—Jan. 2011.*
Reserve Model CLC-DD9 System, Reserve System, Inc., Pumping Unit Produce, Sold in May 2004 for approximately one year.

* cited by examiner

DUAL DISPLACEMENT FLUID LEVEL CONTROL PUMP

BACKGROUND OF THE INVENTION

This invention relates to apparatus and methods for exchange of a fluid between an apparatus reservoir and a reserve reservoir. The new apparatus is a pump that uses only one piston assembly in the central bore of an elongated tubular body to generate and control flow in a two circuit circulating fluid flow system to maintain fluid in an apparatus reservoir.

Historically circulating oil systems have been used over 100 years for maintaining oil levels in gearboxes and other fluid containing apparatus by supply from and overflow back to a reservoir. Such systems not only control the levels closely but also maintain cleaner oil due to the recirculation to the reservoir, which dilutes the contamination levels in the oil proportional to the oil quantity in the reserve. Other and newer systems for engine usage have two pumps: one to adjust a level by removal of excess oil in a crankcase in lieu of overflow, and one to return oil from a reservoir. These have gained acceptance largely in high priced applications. Problems with such systems are primarily cost, complexity and reliability. The use of two pumps for engine level control makes the system vulnerable to failure of one pump without failure of the other, leading to expensive complex construction to guarantee reliability.

U.S. Pat. No. 4,376,449 discloses a two pump circulating oil system utilizing two separate pumps having magnetically driven pistons that pump the two flow circuits of withdrawal and return, with the return of oil being under control of a trigger, this being the primary safety feature. There is a need for a pump that uses only one piston to generate both flow circuits, thus making sure that one flow circuit cannot operate without the other.

U.S. Pat. No. 4,496,287 discloses fluid displacement sensors with reciprocating tubular extensions. These sensors however are strictly limited in their design to the purpose of measuring the compressibility or displaceability of a fluid for information and do not anticipate the independent and primary utility of pumping two simultaneous flow circuits for level control. Also, U.S. Pat. No. 4,747,300 shows fluid displacement sensors and methods of enhancing sensing only.

SUMMARY OF THE INVENTION

The present invention is directed to pumps for exchange of a fluid between an apparatus reservoir and a reserve reservoir. The pump may have an elongated tubular, rectangular or cylindrical, body with a central bore with a reservoir end portion, an inlet end portion and an intermediate barrel portion. A piston assembly with a driving piston with magnetic properties that has a stem member with nonmagnetic attached and the stem member has a tubular extension member attached with all in longitudinal axis alignment may be slidably disposed in the central bore to position the driving piston adjacent to an electromagnetic coil assembly that is disposed around the intermediate barrel portion and to position the tubular extension member for a reservoir end to extend outwardly at the reservoir end opening. An output tubular member may be attached to an output port in a side wall of the reservoir end portion with a first pressure relief valve disposed in the output tubular member for release of fluid through an output port. A sensing electromagnetic coil assembly may be disposed around the intermediate barrel portion adjacent to the electromagnetic coil assembly at the reservoir end portion. The piston assembly may have a piston central bore open at the reservoir end and open at a heel end of the driving piston with a second pressure relief valve and a third pressure relief valve disposed in the central bore adjacent to an inlet port of the inlet end portion. A fourth pressure relief valve may be annularly disposed around the tubular extension member for release of fluid through the reservoir end opening and into the central bore. The electromagnetic coil and the electromagnetic sensor coil may be connected to an electronic power and control circuit.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

The invention described herein utilizes a pump capable of pumping two different flow circuits simultaneously with each having a different rate of flow as compared to the other. Together they can control the oil level in an engine crankcase: using a slower flow circuit to continuously transfer or return oil from a reservoir to the crankcase and a larger flow circuit to withdraw fluid, either air or oil, from a point of withdrawal at the desired running oil level in the crankcase at a faster rate than it can return. In doing so, the oil will automatically adjust to that level. Oil above this point will be pumped to the reservoir until air is withdrawn and the oil level cannot be lowered further. Oil returned from the reservoir will fill the crankcase until it reaches the point of withdrawal where the level cannot rise further because everything above this point will be pumped to the reservoir. Working in concert, the two flow circuits provide a dynamic oil level equilibrium which maintains levels within strict tolerances.

The two different flow rates are achieved by simultaneous, continuous and separate displacement of fluid in the pump in two different cavities, each adjacent to a single driving and pumping piston, and each having a different volume of displacement. Pressure relief valves controlling flow into and out of these cavities limit fluid flow through each cavity to a single direction. Flows into and out of each pumping path will be proportional to the displacement within their respective cavities with lower displacement producing lower flow rates and higher displacement producing higher flow rates.

Figure 1:
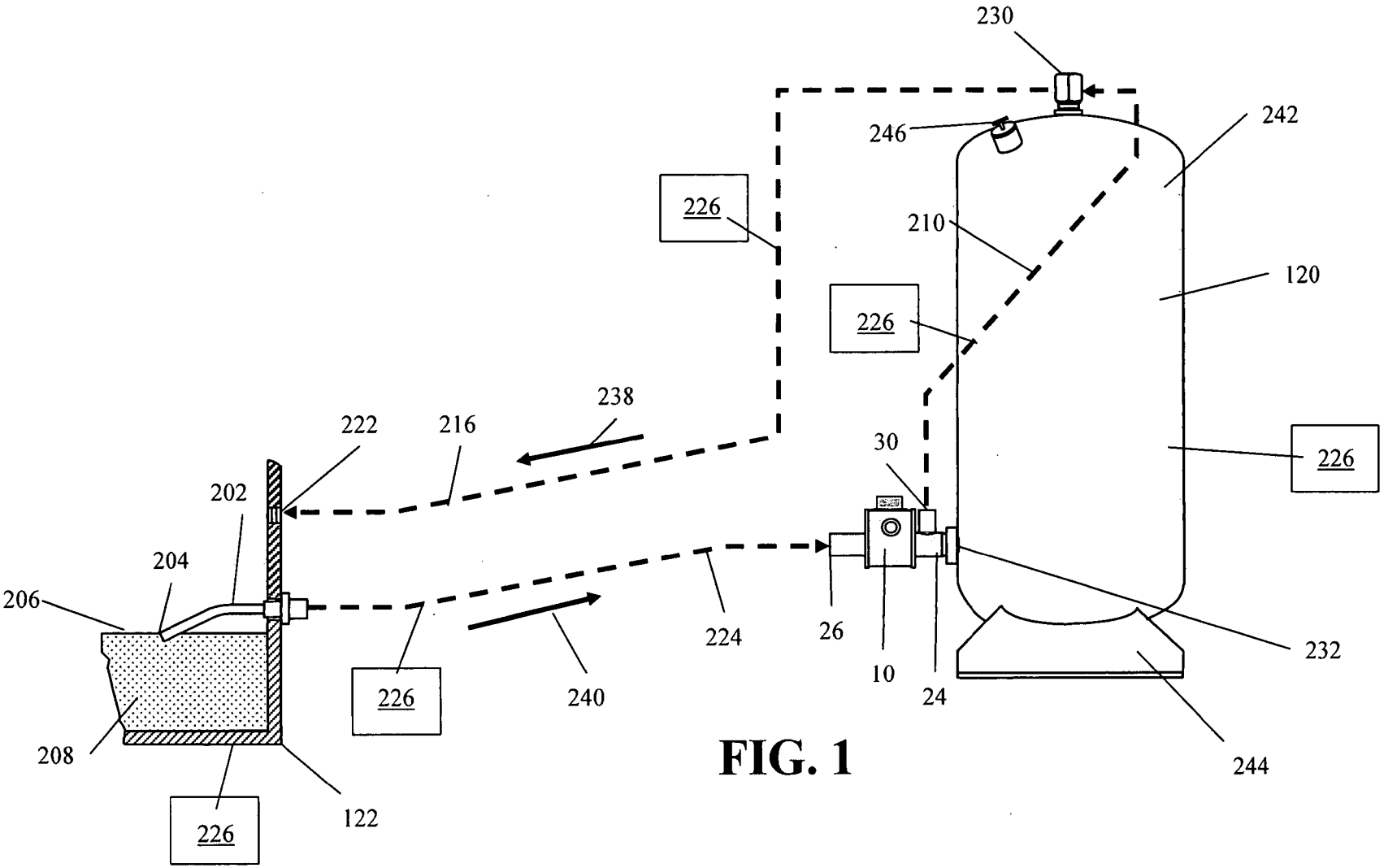
FIG. 1 illustrates a schematic view of a fluid level control system with dual displacement pump according to an embodiment of the invention.
Figure 2:
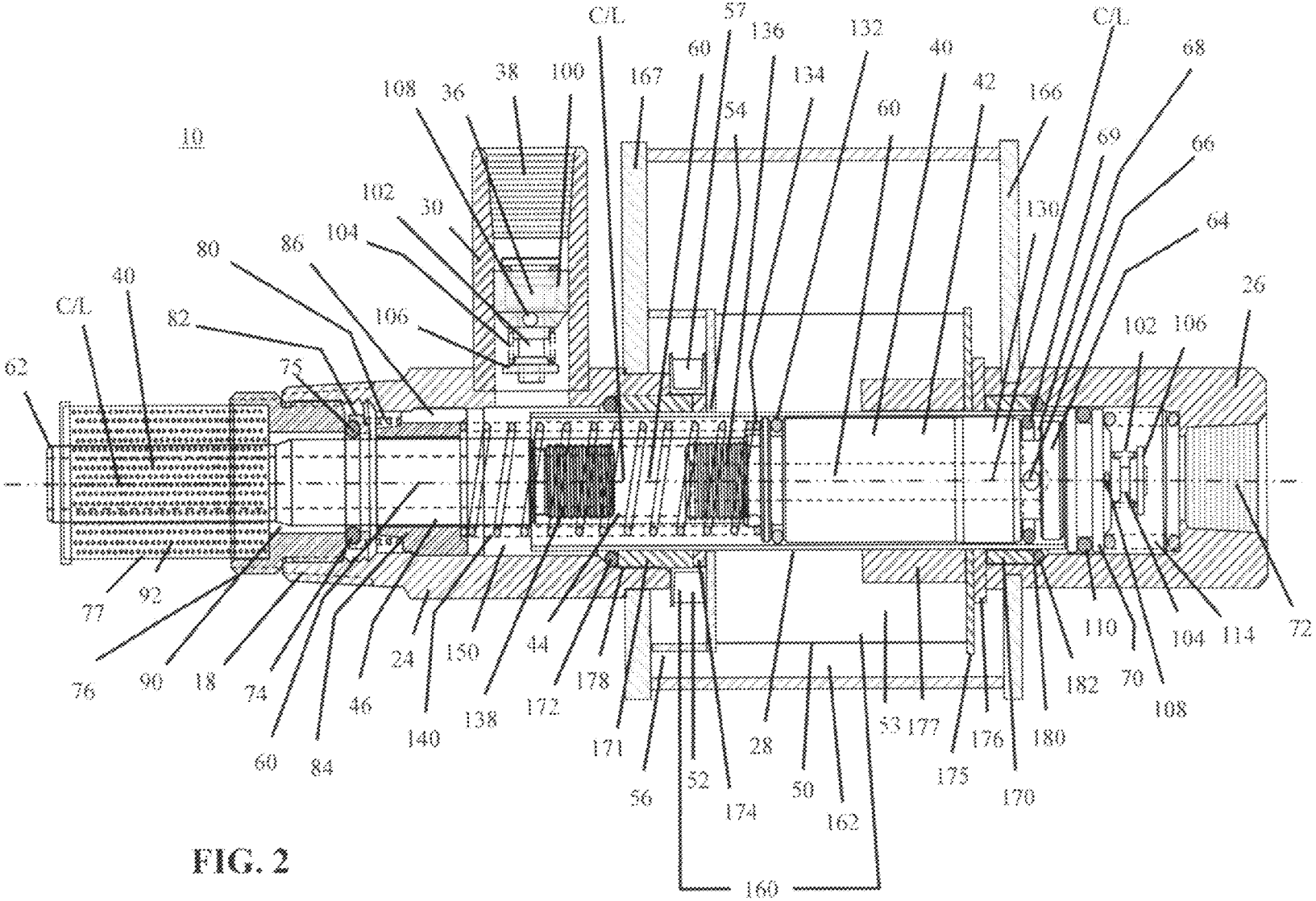
FIG. 2 illustrates a cross-sectional view of a dual displacement pump in a power off position according to an embodiment of the invention.

Referring to FIGS. 1 and 2, the pump 10 may be directly mounted, which does not require additional hoses or hardware to mount to a reserve reservoir 120, which facilitate the transfer of oil and other fluids into and out of the reserve reservoir 120 where the pump mounts, both as a convenience in application and for use of heat generated by the pump or transferred from the engine. The embodiment illustrates using a tubular extension 46 of the pump driving piston 42 that trombones in and, out of the reserve reservoir 120, carries oil and air transferred by the pump 10 to the reserve reservoir 120, and transfers heat from the electromagnetic coil 50 through the piston assembly 40 and its related assembly outward through its tubular extension 46 to warm oil in a limited zone within the reserve reservoir 120 which can be pumped in severe cold weather climates where it would otherwise be too viscous to flow. A novel sliding O-ring pressure relief valve 74 assembly that rides over this tubular extension 46 and directs the internal flow around the tubular extension 46 entering the pump 10. This helps to transfer heat into oil exiting the pump 10 on its return to the engine, which can assist in keeping hose lines flowing in cold applications. Return oil may be filtered, which will exclude air that may transfer into the reserve reservoir 120 so that it cannot short circuit back to the engine, and further provides a thermal trap for heat entering the reserve reservoir 120 from our pump 10.

A pump 10 structure using an electromagnetically driven piston pump because the pump 10 has to be able to pump both air and oil, and must at times run without establishment of flow, such as with cold starts when the oil is frozen and too viscous to flow easily, and must be capable of self-priming. Such pumps 10 decouple the motion of the piston and flow from the motor and cannot be damaged by running without flow. The pump 10 illustrated uses an on and off powering of the electromagnetic coil 50 by an electronic power and control circuit 160 to drive the piston forward when on and allow piston return when the electromagnetic coil 50 is off under force of a piston spring 140.

Referring to FIG. 1, a flow circuit utilizing a pumping unit 10 as described above to perform the task of engine oil level control in an engine crankcase 122 or other fluid apparatus reservoir. Within this crankcase 122 the oil 208, has a level 206, shown at the preferred level to be maintained at the point of fluid withdrawal 204 or of the engine adapter 202. The pumping unit 10 when running causes a suction at its inlet end portion 26, which causes a flow of fluid from crankcase 122, from the point of withdrawal 204, into the engine adapter 202, through hose 224 and into the inlet end portion 26 of pumping unit 10. Delivery of this fluid by pump 10 is into reserve reservoir 120, through reservoir end portion 24, which may be threadably attached into a pipe fitting 232 of reserve reservoir 120. The reservoir end portion 24 may use other configurations such as flange mounting as a substitution for thread mounting without departing form the spirit and scope of this element which is to provide a mounting for pump 10 onto the reserve reservoir 120. The flow circuit from the point of withdrawal at 204 into reserve reservoir 120 is indicated as the fluid withdrawal circuit 240, generally indicated by the flow direction arrow. In actual use the oil level 206 can be variable and thus the fluids pumped through withdrawal circuit 240 can be either oil or air. If the level 206 is higher than the point of withdrawal 204, oil will be pumped or withdrawn through flow circuit 240 until the level 206 is pumped low enough to begin drawing air into the point of withdrawal 204. At this time withdrawal circuit 240 will then transfer only air to reserve reservoir 120 and the pumping unit 10 cannot lower the level 206 below the point of withdrawal 204. For the purpose of definition the air so withdrawn, while not numbered or shown, is assumed to be any fluid above the oil level 206 within the crankcase 122.

The reserve reservoir 120 may be a tank 242, having mounting brackets 244, pipe fitting 232, filler position 246, and relief anti-siphon check valve 230. This tank 242 may in actual field service vary from the embodiment shown which is generic in nature, and may have vents, braces, different shapes, components and or varying locations of components without limitations as long as it is able to perform the service of holding oil for engine usage, for mounting the pumping unit 10, and for receiving the flow from withdrawal circuit 240. Additionally, one item, the anti-siphon valve 230 is considered optional in field service according to a specific installation.

The pumping unit 10 has an oil return flow circuit 238 generally indicated by the arrow. Flow through circuit 238 is through the following paths: oil from reserve reservoir 120 is drawn into the pump reservoir end portion 24, exiting the pump 10 at the output tubular member 30, hose 210, optional anti-siphon valve 230, hose 216 and delivered to inlet port 222 in crankcase 122. Oil thus delivered through oil return flow circuit 238 will accumulate in crankcase 122 and raise level 206 if it is below the point of withdrawal 204, until the pump 10 begins to withdraw oil instead of air through the fluid withdrawal circuit 240. At this time, as the fluid withdrawal circuit 240 has a larger flow rate than oil that can be delivered to the crankcase 122 through the return circuit 238 with its slower flow rate, the oil level will be lowered to or maintained at the point of fluid withdrawal 204. In actual field service the fluids flowing through the fluid withdrawal circuit 240 will be alternately air, oil or a mixture of the two.

Figure 3:
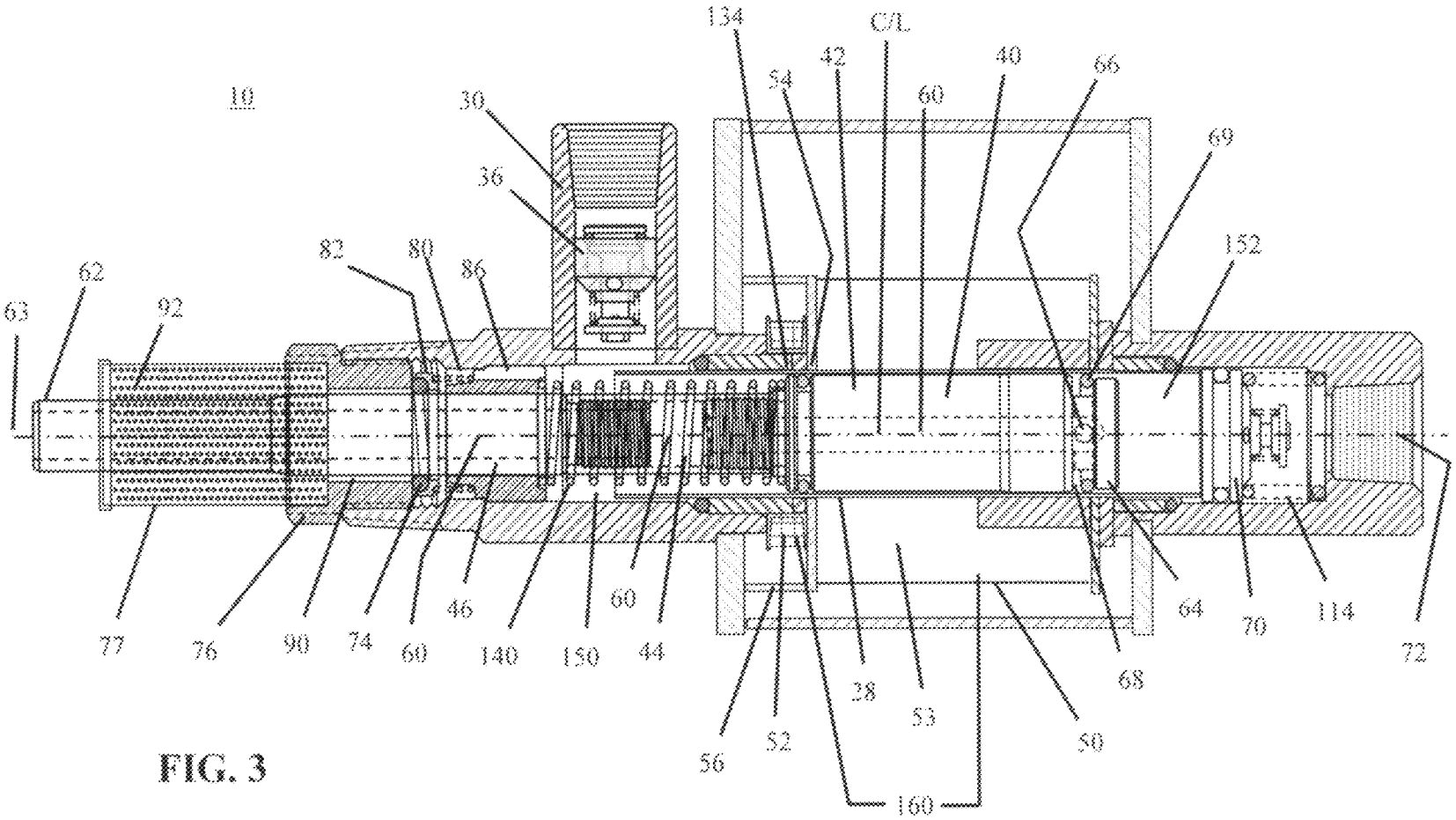
FIG. 3 illustrates a cross-sectional view of a dual displacement pump in a power on position according to an embodiment of the invention.

As will be explained in the description with reference to FIG. 2 and FIG. 3 to follow, the fluid withdrawal circuit 240 has a larger flow rate than has the return circuit 238 because the pump 10 has different displacement volumes within its internal components pumping the separate circuits 238 and 240. Larger displacements within pump 10 give larger flow rates and lower or smaller displacements give slower flow rates. FIG. 2 and FIG. 3 are similar cross sections of the same pumping unit 10 showing two different stages of operation. The description of the internal operation of pump 10 will be done after the description of the elements of FIG. 3 where the stages of pump 10 operation may be easily differentiated.

Referring to FIG. 2 that is a cross section of the pumping unit 10, the outer structure includes the withdrawal inlet end portion 26, which may be connected to withdrawal conduit 202 of the apparatus reservoir 120 may be furnace brazed to a plate or wall 166. On the other end of the pumping unit 10 is the reservoir end portion 24 that may have threads 18 for threading into pipe fitting 232 as illustrated in FIG. 1 and reservoir end portion 24 may be furnace brazed to plate or wall 167. Return tubular outlet 30 may also be brazed to end 24. Plates or walls 166,167 may sandwich the central housing 162 of rectangular tubular shape with the aid of bolts and nuts (not shown).

Within pump frame or central housing 162 is the electromagnetic coil assembly 50, having the electromagnetic windings of magnet wire 53 and which provides the driving force for the pump 10. The coil assembly 50 is wound of magnet wire 53 onto the piston barrel 28 constructed of austenitic stainless steel and is retained on one end by the coil assembly pieces steel ring 170, steel coil inlet end plates 175 and 176, and steel ring 177, and on the other coil end by the steel sensing cup housing 56 centered around the barrel 28 by the magnetic field housing 54, sensing electromagnetic coil assembly 52 wound of magnet wire 57, nonferrous material spacer 174 and steel ring 171. During pump 10 assembly the assembled and wound assembly electromagnetic coil 50 on barrel portion 28 is slid into the reservoir end bore 178 so that ring 171 compresses O-ring 172 to seal this end of pump 10 from fluid leakage, and on the other end ring 170 slides into bore 180 of inlet 26 and compresses O-ring 182 to seal this inlet 26 of the pump 10 from fluid leakage.

Within the withdrawal inlet 26 and positioned on one end by the barrel 28 is the withdrawal inlet valve assembly or third pressure relief valve 70, which is positioned on its other end by the buffer spring 114. Valve assembly 70 is sealed against the inlet end portion 26 by O-ring 110. The valve assembly 70 is ported at drilled holes 108 to allow pressure changes to urge motion of the poppet 102 (only partially shown) against the force of valve spring 104 which is retained by retainer 106, the pressure relief valve 70 can open and close to allow flow through it in one direction only. The inlet 26 is threaded at the inlet port 72 to allow insertion of a hose fitting (not shown), whereby the hose 224 of FIG. 1 may be connected.

The steel piston assembly 40 is slidably inserted into intermediate barrel portion 28. Its primary components are the driving piston body 42, the nonmagnetic stem member 44 connected through the driving piston threaded end 136, and the tubular extension member 46, also connected through the threaded extension member end 138. The piston assembly 40 as shown in FIG. 2 is at rest as when not powered off. FIG. 3 illustrates the piston in a forward position as when powered on. The piston assembly 40 in FIG. 2 is centered in the reservoir portion 24 by the alignment of annular bearing 84 that has a slot or port 86 for fluid passage. The tubular extension 46 of piston assembly 40 slips into the bearing 84 so that it can slide within, and on the other end of the driving piston body 42 bearing 130 that aligns the piston assembly 40 so it can slide within the barrel 28. Piston spring 140 fits on the stem end 134 of the driving piston 42 over the stem 44 and tubular extension 46 and centers between the bearing 84 and the stem end 134 of driving piston 42. O-ring 132 seals between the driving piston 42 and the barrel 28.

Passages for fluid flow into and through the piston assembly are: from the direction of port 72 in the inlet end portion 26, through the valve assembly 70 toward the piston assembly 40. Fluid flow continues around the heel 64 of the driving piston body 42 to the groove 68, past the sliding O-ring valve or second pressure relief valve 69, through the drilled access ports 66, into and through passage 60 of the driving piston 42, into and through the passage 60 of the stem 44, into and through the passage 60 of the tubular extension 46 and out the reservoir end 62 of the tubular extension 46 into the reserve reservoir 120 of FIG. 1. The description of how and when these flows are developed are presented with reference to FIG. 3 below.

The path of oil flow into the reservoir portion 24 is into and through the filter and thermal trap 77 via the apertures 92, into the passage 90 of bushing 76, around O-ring slide valve or fourth pressure relief valve assembly 74 which contains the O-ring 75 and the O-ring compression retainer 82 that slide on the tubular extension 46, past valve spring 80, through the slot 86 of bearing 84, and into the central cavity 150 which also contains the spring 140. The fourth pressure relief valve assembly 74, while illustrated here as being positioned and closed by the spring 80 in practice may operate well and close adequately without the spring 80. Inclusion of the spring 80 is redundant for reliability of the positioning of the relief valve assembly 74. Passages out of the cavity 150 are through the first pressure relief valve assembly 36 and through the output port 38 of the outlet tubular member 30. This outlet tubular member 30 is shown in FIG. 1 connecting to hose 210. The first pressure relief valve assembly 36 contains the following parts and features. The valve body 100 has the drilled ports 108. Movement of the poppet 102 allows flow through drilled passages 108. The poppet 102 is maintained at rest in the closed position illustrated by the force of spring 104 which is retained by the retainer 106.

The pump 10 of FIG. 2 shows the piston assembly 40 at the resting position under the force of the spring 140 when the coil 50 is not powered on by the electric power and control circuits 160. The actual circuits 160 are not herein shown but are functionally illustrated in the drawings pointing to the magnet wire windings 53 and 57 wherein the circuits 160 connect. FIG. 3 illustrates the same pump 10, having all of the same components of the piston assembly 40 in a forward position when the coil is powered on. The coil assembly 50 when powered on by circuit 160 produces a magnetic force that pulls driving piston 42 forward, with its stem end 134 to a point adjacent to the sensing coil cup housing 56 at its magnetic field housing 54. Motions of the driving piston 42 are transferred into the entire piston assembly 40, as the stem member 44 and tubular extension member 46 are mechanically coupled to the piston 42. Concurrent with this motion the reservoir end 62 of the tubular extension 46 also reciprocates inward and outward into reserve reservoir 120 of FIG. 1.

Referring to FIG. 3, the pump 10 shows the piston assembly 40 pulled into a forward position away from the third pressure relief valve 70 against the force of spring 140 to form a withdrawal cavity 152, such as when the electromagnetic coil 50 is powered on by electronic power and control circuit 160. During the forward motion of the piston assembly 40 the second pressure relief valve 69, illustrated as an O-ring, slides rearward against the heel portion 64. The motion of valve 69 seals the piston assembly 40 against the barrel 28 causing a suction or vacuum in the cavity 152 during the forward motion of piston assembly 40. This in turn causes suction inward through pressure relief valve assembly 70 and through the inlet port 72 to cause flow into the pump from the fluid withdrawal circuit 240, see FIG. 1.

The forward motion of the piston assembly 40 also causes the central cavity 150 to become compressed or pressurized. As the spring 80 is holding the fourth pressure relief valve assembly 74 to close against the bushing 76 as a check valve leaving the only flow possible out the first pressure relief valve assembly 36 and through the tubular outlet 30. This causes the flow through the return oil flow circuit 238, see FIG. 1.

The cavity 150 has a lower volume displacement for any given motion of the piston assembly 40, based upon the diametric area of the driving piston 42 times the linear motion, than that of cavity 152. The diametric area of the piston 42 in the cavity 150 is reduced proportionally to the diametric area of the stem 44 and tubular extension 46 of the piston assembly 40. Linear motion of the piston assembly 40 therefore generates a smaller effective volume displacement for cavity 150 than for cavity 152. Therefore the volume of fluid that can be ejected from inlet cavity 152, from the withdrawal flow circuit 240 illustrated in FIG. 1, for any given return motion of the piston assembly 40 is larger than can be ejected from the central cavity 150 during the forward motion of the piston assembly 40, through the return flow circuit 238 illustrated in FIG. 1.

When the electromagnetic coil assembly 50 is not powered on, such as would happen at the end of a forward stroke of the piston assembly 40 as shown in FIG. 3, the piston assembly 40 will be urged rearward by the force of spring 140 until it resides in the position shown in FIG. 2 for the piston assembly 40. Unobstructed motion of the piston assembly 40, such as when the pump 10 is filled with air, will be buffered by the recoil buffer spring 114. During this motion the second pressure relief valve 69 will be pushed away from the heel 64 to the opposing face of the groove 68 of the driving piston 42 as shown in FIG. 2. This will allow the fluid in cavity 152 as shown in FIG. 3 to flow through the piston assembly 40, over heel 64, past the second relief valve 69, groove 68, ports 66, through the piston central bore 60 and outward from the end 62 through the tubular opening 63 of the tubular extension 46 as the cavity 152 now becomes pressurized by the rearward motion of the piston assembly 40. Simultaneously, as the first pressure relief valve assembly 36 will be closed oil will flow from the reserve reservoir 120, see FIG. 1, through the apertures 92 of the filter and thermal trap 77 of the pump 10, through the passage 90 of bushing 76 and past the fourth pressure relief valve 74, retainer 82, spring 80 and slot 86 to the cavity 150 under the suction created in the cavity 150 by the rearward motion of the piston assembly 40.

The pump 10 thereby has a cycle of alternate pressure and suction within each of the two cavities 152 and 150, which causes flow through the pump 10 through the flow circuits 240 and 238, see FIG. 1. Because inlet cavity 152 has a higher volume displacement than central cavity 150, flow rates through the flow circuits 240 and 238 are different. The displacement of inlet cavity 152 causes a larger flow than does the displacement of central cavity 150 which causes a slower rate of flow.

Within the pump 10 the sensing electromagnetic coil assembly 52 provides a sensing of the motion of piston assembly 40 during the power on time of the electromagnetic coil assembly 50. As the piston assembly 40 pulls forward the driving piston 42 stem end 134 engages the magnetic path through the sensing coil housing frame 56. As the stem end 134 moves further forward and comes adjacent the magnetic field housing 54 of sensing housing frame 56 and transfers flux from the electromagnetic coil 50 around the sensing coil assembly 52. This sensing coil 52 in turn generates an electrical signal that varies in both time and intensity proportional to the velocity of the piston assembly 40 and the time in which it reaches the area adjacent to the magnetic field housing 54. The velocity is much larger when air is pumped in either of the two cavities 150 or 152 than when pumping oil. A wide range of data may be generated from this sensing of fluids pumped. One piece of information that is possible is to determine when the pump 10 is only pumping air in both directions thus indicating an empty reservoir. The before referenced U.S. Pat. No. 4,376,449 explains the mechanism of piston velocity sensing to differentiate between fluid condition and is hereby incorporated by reference, and the mechanism of how the sensing coil signals look, are correlated or relate to plunger motion is well known in the art.

The structure, in addition to providing for simple mounting of the pump 10, also may assist in the transfer of heat from the pump 10 outward to its oil source, such as reserve reservoir 120, see FIG. 1, which can assist in flow of highly viscous oils such as found in subzero weather. Alternate mountings such as bolted flanges are for this purpose considered equivalent so long as they provide an area for direct exchange of fluids between the pump 10 and the reservoir.

The coil assembly 50 of FIG. 3 is formed around a selection of metal parts or other thermally conductive materials, so that heat generated within the magnetic wire 53 as it is pulsed on by electronic power and control circuit 160 can transfer through this coil assembly 50 into the plunger assembly 40, which carries the heat outward to its end 62 of the tubular extension 46. We have found from testing that this pump 10 can transfer a large quantity of its heat into the oil entering the filter 77. Also, it has been determined that the filter adds value as a trap for heat that would otherwise be partially lost into other portions of the reserve reservoir 120, see FIG. 1. Additional heat may go into oil exiting the tubular outlet 30 or is radiated away from the pump 10 through other parts. The end 62 is designed to deliver fluid outside the filter 77, where it sprays outward through the opening 63 so that the pump 10 will be less likely to return air back to the engine (not shown) instead of oil. As an addendum to the heat transfer, the fourth pressure relief valve 74, because it valves directly over the warmed surface of the tubular extension 46, with the aid of close fitting passage 90, helps to direct the oil directly over the tubular extension 46 as it enters the pump 10, improving heat transfer into the oil.

In practice, oil level systems are all limited in their usability in extreme low temperatures because of the difficulty in making oil flow. It is common to utilize tank heaters and sometimes heat ribbons or lines mounted either inside or outside any or all suction and pressure hoses or piping, and whether thermostatically controlled or thermally self-regulating to make oil flow possible. The pump 10 may utilize such heat sources 226 in combination, but note that under many conditions the ability of the pump 10 to heat the oil in reserve reservoir 120 of FIG. 1 may replace the necessity for one or more applied heat sources 226. Referring to FIGS. 1 and 2, the fluid return flow circuit 238 and fluid withdrawal circuit 240 may have a heating source 226 mounted either inside or outside of the first conduit 224 or the third conduit 216. These heating sources 226 may be operated to heat oil in the conduit in combination with the operation of the pump 10 when actuating the piston assembly 40 to cause the tubular extension model 46 to telescope in and out within the reserve reservoir 120 tank. This combination may serve to facilitate the flow of oil in the fluid level control system. The second conduit 210 may also have a heating source 226 mounted. In addition, the reserve reservoir 120 and apparatus reservoir 122 may each have a heating source 226 mounted either inside or outside the reservoir or tank to be operated in combination with the pump 10 and various conduits 210, 216 and 224.

The embodiments shown are only one of the many and varied constructions possible of this pump all of which could have commonality of function with illustrated embodiments.

In this description, reference to displacement volumes, volume of displacement, different displacement volumes, volumes being proportional to displacement, lesser or larger displacement volumes, distinctly different volumes, larger or smaller volumes or displacement volumes, and higher or lower displacement or any other references to differences in displacement or volume of one or more cavities or chambers will be alleged to refer to the same phenomena regardless of specific language provided. Similarly, reference to different rates of flow, lesser or larger rates of flow, slower or faster rates of flow, different rates of fluid withdrawal or return, shall be alleged to refer in a similar manner to any difference in flow rates of a fluid or oil that may be caused by differences in displacement.

Also, reference to valves, check valves, poppet valves and or pressure relief valves are intended to refer to various and sometimes interchangeable construction and are not by the language used in their description to be exclusive of substitute constructions which may perform like duty.

While the invention has been particularly shown and described with respect to the illustrated embodiments thereof, it will be understood by those skilled in the art that the foregoing and other changes in form and details may be made therein without departing from the spirit and scope of the invention.

We claim:

1. A pump for exchange of a fluid between an apparatus reservoir and a reserve reservoir comprising:

an elongated tubular body with a central bore that has a reservoir end portion terminating in a reservoir end opening, an inlet end portion terminating in an inlet port and an intermediate barrel portion positioned between the reservoir end portion and inlet end portion;

a piston assembly having a stem member that is nonferrous disposed between a driving piston having a heel end and a tubular extension member having a reservoir end, said piston assembly is slidably disposed in said central bore of said elongated tubular body to position said driving piston adjacent to an electromagnetic coil assembly that is disposed around said intermediate barrel portion and to position said tubular extension member such that said tubular extension member reciprocates at said reservoir end opening;

a piston spring is positioned over said stem member and said tubular extension member and positioned against said driving piston on a stem end;

an output tubular member is attached to an output port in a side wall of said reservoir end portion with a first pressure relief valve disposed in said output tubular member for release of fluid through said output port;

said piston assembly has a piston central bore open at said reservoir end of said tubular extension member and open adjacent said heel end of said driving piston with a second pressure relief valve adjacent said heel end, and a third pressure relief valve disposed in said central bore between said heel end and adjacent to an inlet port of said inlet end portion;

a fourth pressure relief valve is annularly disposed on said tubular extension member between a bushing attached in said reservoir end portion at an open end and an annular bearing in said central bore for release of fluid through said reservoir end opening and into said central bore;

said electromagnetic coil is connected to an electronic power and control circuit;

wherein operation of said pump creates a first fluid flow circuit into said pump at inlet of said body, into said piston central bore adjacent said heel end of said driving piston and out of said piston central bore at said reservoir end of said tubular extension member of said piston assembly and out of said pump at said reservoir end opening of said body, and also creates a second fluid flow circuit into said pump at said reservoir end opening of said body, between said central bore of said body and said tubular extension member, and out said pump at said output port of said output tubular member, and wherein said first fluid flow circuit has a greater volumetric flow rate than said second fluid flow circuit.

2. The pump as in claim 1 wherein a sensing electromagnetic coil assembly is disposed around said intermediate barrel portion adjacent to said electromagnetic coil assembly at said reservoir end portion and is connected to said electronic power and control circuit.

3. The pump as in claim 1 wherein said first and said second pressure relief valves are of the poppet type with a valve body with a slidably disposed poppet biased by a spring in a closed position with a spring retainer and with a port positioned to allow fluid pressure to urge said poppet to an open position to allow fluid flow through said pressure relief valve.

4. The pump as in claim 1 wherein said fourth pressure relief valve comprises an O-ring slidably disposed on said tubular extension member in said central bore between said bushing and an O-ring compression retainer ring that is spring biased against said O-ring by an annular bearing spring disposed between said O-ring compression retainer ring and an annular bearing in said tubular extension member.

5. The pump as in claim 1 wherein said an electronic power and control circuit is structured to apply electric power to said electromagnetic coil assembly to cause an electromagnetic field in said driving piston to move said driving piston in said central bore against the force of said piston spring to urge said piston assembly away from said inlet port to form an Inlet cavity between said heel end of said driving piston and said third pressure relief valve; and to reduce the volume of a central cavity disposed generally around said stem member and in a portion of said output tubular member.

6. The pump as in claim 5 wherein removal of electric power causes said driving piston to be urged toward said inlet port to reduce the volume of said inlet cavity and to increase the volume of said central cavity.

7. The pump as in claim 5 wherein said tubular body, said piston assembly and said tubular member are structured for said inlet cavity to have a larger volume when expanded than said central cavity has when it is expanded.

8. The pump as in claim 1, wherein said second pressure relief valve is constructed with an O-ring disposed in a groove in said driving piston adjacent said heel end.

9. The pump as in claim 1 wherein a filter and thermal trap of hollow cylindrical form having a plurality of apertures therein is attached to said bushing to extend outwardly to enclose a portion of said tubular extension member at said reservoir end.

10. A method for control of the fluid level in an apparatus reservoir comprising:

(a) providing a reserve reservoir;

(b) providing a pump for exchange of a fluid between said apparatus reservoir and said reserve reservoir comprising:

an elongated tubular body with a central bore that has a reservoir end portion terminating in a reservoir end opening, an inlet end portion terminating in an inlet port and an intermediate barrel portion positioned between the reservoir end portion and inlet end portion;

a piston assembly having a stem member that is nonferrous disposed between a driving piston having a heel end and a tubular extension member having a reservoir end, said piston assembly is slidably disposed in said central bore of said elongated tubular body to position said driving piston adjacent to an electromagnetic coil assembly that is disposed around said intermediate barrel portion and to position said tubular extension member such that said tubular extension member reciprocates at said reservoir end opening;

a piston spring is positioned over said stem member and said tubular extension member and positioned against said driving piston on a stem end;

an output tubular member is attached to an output port in a side wall of said reservoir end portion with a first pressure relief valve disposed in said output tubular member for release of fluid through said output port;

said piston assembly has a piston central bore open at said reservoir end of said tubular extension member and open adjacent said heel end of said driving piston with a second pressure relief valve adjacent said heel end, and a third pressure relief valve disposed in said central bore between said heel end and adjacent to an inlet port of said inlet end portion;

a fourth pressure relief valve is annularly disposed on said tubular extension member between a bushing attached in said reservoir end portion at an open end and an annular bearing in said central bore for release of fluid through said reservoir end opening and into said central bore;

said electromagnetic coil is connected to an electronic power and control circuit;

wherein operation of said pump creates a first fluid flow circuit into said pump at inlet of said body, into said piston central bore adjacent said heel end of said driving piston and out of said piston central bore at said reservoir end of said tubular extension member of said piston assembly and out of said pump at said reservoir end opening of said body, and also creates a second fluid flow circuit into said pump at said reservoir end opening of said body, between said central bore of said body and said tubular extension member, and out said pump at said output port of said output tubular member, and wherein said first fluid flow circuit has a greater volumetric flow rate than said second fluid flow circuit;

(c) mounting said pump to said reserve reservoir such that said reservoir end of said tubular extension member reciprocates into and out of said reserve reservoir during operation of said pump;

(d) connecting a first conduit to said inlet end portion of said pump and to an apparatus outlet in said apparatus reservoir;

(e) connecting a second conduit to said output port of said pump to an apparatus inlet in said apparatus reservoir; and (f) connecting an electronic power and control circuit to an electric power source such that power is applied in intervals to enable operation of said pump.

11. The method of claim 10 wherein said fluid is drawn from said apparatus reservoir by said pump at a greater flow rate than the flow rate at which fluid is drawn from said pump into said apparatus reservoir.

* * * * *